US006493452B1

(12) United States Patent
Koizumi et al.

(10) Patent No.: US 6,493,452 B1
(45) Date of Patent: Dec. 10, 2002

(54) SPEAKER UNIT

(75) Inventors: Hiroshi Koizumi, Saitama (JP); Hachishiro Kobayashi, Tokyo (JP); Hideki Minami, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/313,587

(22) Filed: May 18, 1999

(30) Foreign Application Priority Data

May 20, 1998 (JP) ..... 10-138694

(51) Int. Cl.[7] ..... H04R 25/00

(52) U.S. Cl. ..... 381/182; 381/186; 381/423; 381/432; 181/144; 181/174

(58) Field of Search ..... 381/182, 186, 381/389, 342, 381, 184, 386, 423, 432, FOR 162, FOR 164; 181/174, 163, 144, 147, 145

(56) References Cited

U.S. PATENT DOCUMENTS 1,965,405 A * 7/1934 Blattner
3,586,121 A * 6/1971 Sotome ..... 381/174
4,182,429 A * 1/1980 Senzaki ..... 181/144
4,379,951 A * 4/1983 Gabr
4,475,014 A * 10/1984 King ..... 179/110 A
4,672,675 A * 6/1987 Powell ..... 381/182
5,062,139 A * 10/1991 Christensen ..... 381/192
5,568,562 A * 10/1996 Huang ..... 381/186
5,739,480 A * 4/1998 Lin ..... 181/144
5,802,191 A * 9/1998 Guenther ..... 381/188
6,064,744 A * 5/2000 Augustine ..... 381/160

* cited by examiner

*Primary Examiner*—Huyen Le
(74) *Attorney, Agent, or Firm*—Jay H. Maioli

(57) ABSTRACT

A speaker unit includes a woofer having a diaphragm with an ellipse shape sound emitting opening, and a separate speaker having an ellipse shape diaphragm with an area smaller than that of the diaphragm of the woofer, located in front of the diaphragm of the woofer, attached to a center axis of the ellipse shape of the woofer coincident with that of the ellipse shape of the separate speaker, and emitting a sound higher in frequency than that of the woofer.

4 Claims, 6 Drawing Sheets

SPEAKER UNIT

BACKGROUND OF THE INVENTION

1. Field of the Invention

The present invention relates to a speaker unit of a composite coaxial type suitable for use as a speaker unit installed in a car, for example.

2. Description of the Related Art.

In the prior art, when a plurality of speakers handling different frequency bands are disposed in a narrow space, the speakers are made as a composite coaxial type of, for example, a two-way system. By arranging the composite coaxial type speaker, as compared with a case where speakers for middle or intermediate frequency sound and low frequency sound are located at different positions in a single cabinet, a sound of intermediate frequency band together with a sound of low frequency band, of course, is emitted from substantially the center position of a speaker for low frequency sound so that the directivity such as a sound image localization or the like is improved.

Further, such a woofer or low frequency sound speaker in which an opening of a cone type diaphragm on its sound emitting side is shaped as an ellipse is used widely. By making the sound emitting opening of the diaphragm as an elliptic shape, it is advantageous when the speaker unit is installed in a limited narrow space such as in a car or the like.

Under the concept mentioned above, in a low frequency sound speaker, or an ellipse type speaker in which a front end, namely a sound emitting opening portion of a cone type diaphragm is made of an ellipse, there is proposed an intermediate or middle frequency sound speaker which is disposed in such a manner that the sound emitting opening portion of the cone shape diaphragm is concentric at the center position of the diaphragm at the front portion of the diaphragm of the low frequency sound speaker.

In case of such a composite coaxial type speaker, there are generated much cross modulation distortions near the cross-over frequency of each of the low and intermediate frequency band speakers and many crests and troughs are caused on a frequency characteristic curve. Hence, it is difficult to obtain a flat characteristic, which lowers the sound quality.

The fact that the sound emitting opening of the low frequency sound speaker is of an ellipse means that the ellipse has a long diameter direction and a short diameter direction.

Since there is coaxially located the intermediate frequency sound speaker, the sound emitting opening of which is of circle, the sound wave emitted forward from the long diameter direction and the sound wave emitted forward from the short diameter direction are reflected on and differected by the rear portion of the circular intermediate frequency sound speaker, namely its frame. As a result, there is caused a phase difference between the sound wave emitted from the long diameter direction and the sound wave emitted from the short diameter direction. This phase difference becomes the distortion which deteriorates the frequency characteristics. Further, the directivities of the sound waves emitted from the long and short diameter directions are different each other and hence the directivity characteristic is deteriorated.

SUMMARY OF THE INVENTION

An object of the present invention is to provide a speaker unit which solves the problems mentioned above.

According to an aspect of the present invention, there is proposed a coaxial type speaker, in which a low frequency sound speaker, the sound emitting opening of a diaphragm of which is of an ellipse and at least an intermediate frequency sound speaker, the sound emitting opening of a diaphragm of which is of an ellipse, are arranged coaxially, whereby the difference between directivity characteristics of the sound waves in the long diameter direction and the short diameter direction of the elliptic type low frequency sound speaker is removed and hence the frequency characteristics are improved.

According to another aspect of the present invention, there is provided a composite coaxial speaker unit in which an elliptic type intermediate and high frequency sound speaker is disposed on the center axis of an ellptic type low frequency sound speaker at its front sound emitting opening portion, and the sound emitting opening portion of a diaphragm of the elliptic type low frequency sound speaker and the sound emitting opening portion of a diaphragm of the elliptic type intermediate and high frequency sound speaker are made as a similar figure substantially.

According to the speaker unit of the present invention, since the intermediate and high frequency sound speaker arranged coaxial with the center of the elliptic type low frequency sound speaker is made as an ellipse similar to the low frequency sound speaker, a speaker unit, the frequency characteristics and the directivity characteristics of which are improved and which is suitable to be installed on a car, can be obtained.

DESCRIPTION OF THE PREFERRED EMBODIMENTS

Figure 1:
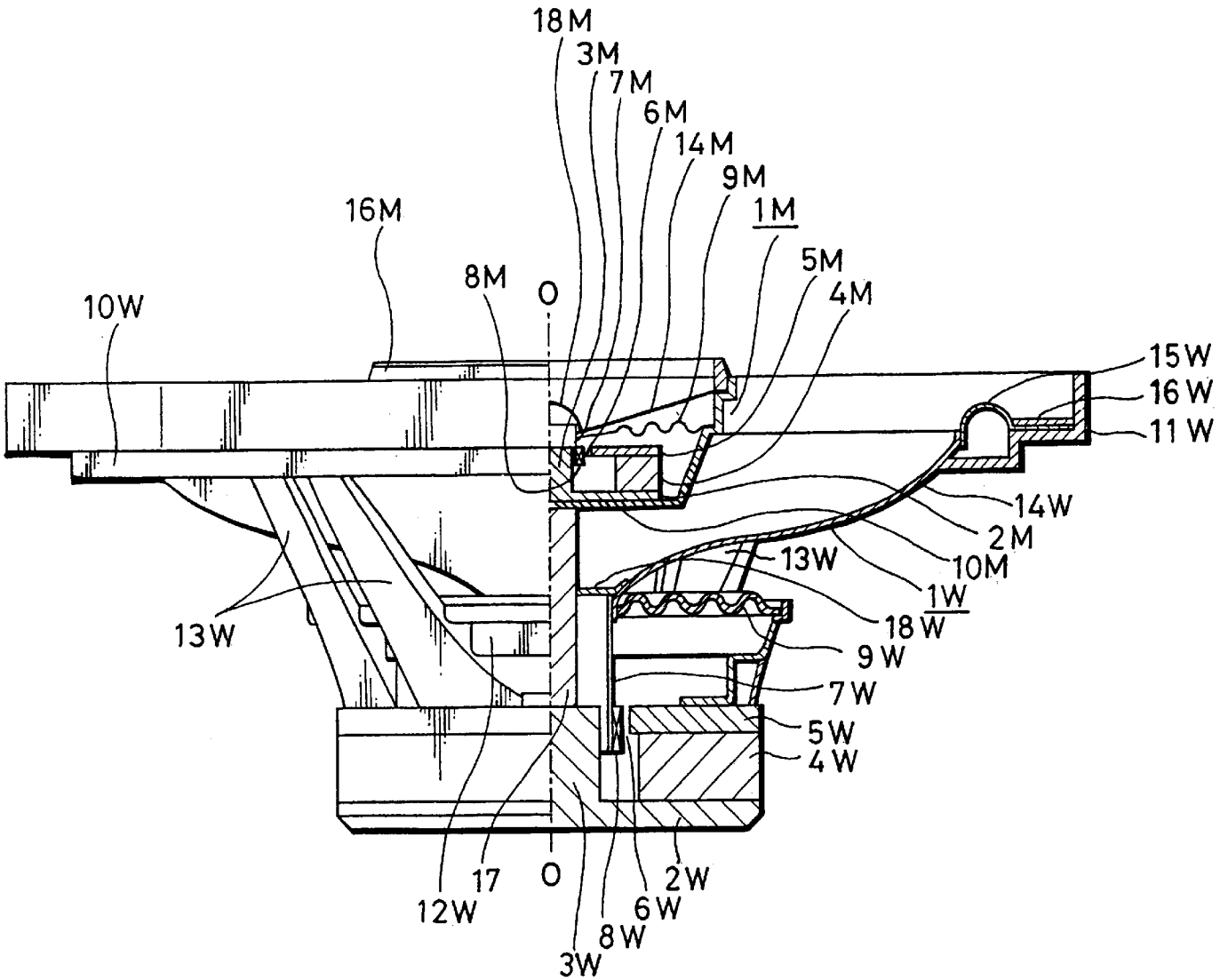
FIG. 1 is a side view of a speaker unit according to an embodiment of the present invention whose one portion is shown in cross-section.
Figure 2:
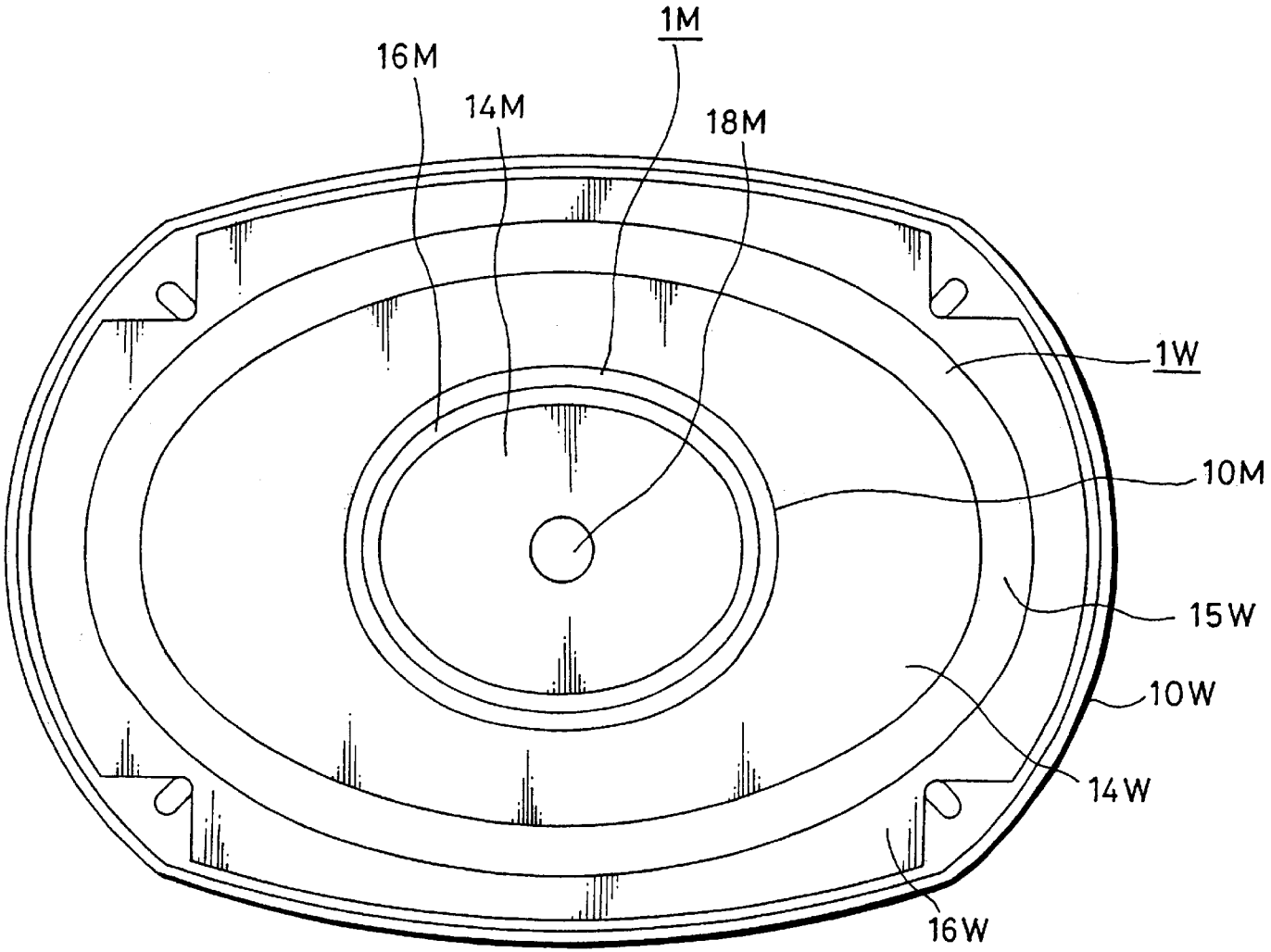
FIG. 2 is a plan view of the speaker unit according to the present invention.

An arrangement of a first embodiment of the speaker unit according to the present invention will be described with reference to FIG. 1 showing a side view of the first embodiment whose left portion from a center axis 0—0 is shown in cross-section and FIG. 2 showing the plan view of the first embodiment.

In FIGS. 1 and 2, a low frequency sound speaker hereinafter, referred to as a woofer) 1W and an intermediate or middle frequency sound speaker 1M are arranged coaxially. In this case, the reproduction frequency band of the woofer 1W is set about 50 HZ to 3 KHz, while the reproduction frequency band of the intermediate or middle frequency sound speaker 1M is set about 3 KHz to 10 KHz.

The woofer 1W and the middle frequency sound speaker 1M are both shaped as a cone type and an electrodynamic type speaker whose magnetic circuit is formed as, for example, an outer magnet type. The magnetic circuits and the vibration system of the woofer 1W and the middle frequency sound speaker 1M except for the sizes thereof are formed similar approximately. Therefore, in the following description, portions on the woofer side are attached with W as a suffix, while portions on the middle frequency sound speaker side are attached with M as a suffix, and the same portions are marked with the same reference numerals and then described.

As shown in FIG. 1, there are provided yokes 2W, 3W shaped as about discs, made of pure iron or the like and having center poles 3W, 3M planted thereon at their center portions. To the upper sides of the disc-shaped yokes 2W, 2M, there are respectively bonded through an adhesive or the like ring-shaped magnets 4W, 4M made of ferrite. Further, ring-shaped plates 5W, 5M made of pure iron or the like are bonded via an adhesive or the like to the upper sides of magnets 4W, 4M, respectively.

In magnetic gaps 6W, 6M defined between the outer peripheral portions of the center poles 3W, 3M and the inner peripheries of apertures bored through the ring-shaped plates 5W, 5M, voice coils 8W, 8M wound around bobbins 7W, 7M are located, respectively. Magnetic circuits are formed by the yokes 2W, 2M having the plates 5W, 5M, the magnets 4W, 4M and the center poles 3W, 3M; and the magnetic gaps 6W, 6M comprised of the plates 5W, 5M and the center poles 3W, 3M. When drive currents flow through the voice coils 8W, 8M, diaphragms 14W, 14M attached to the bobbins 7W, 7M respectively are vibrated in the front to rear direction to produce a sound.

Frames 10W, 10M are made of synthetic resin or the like to have openings of long circles or substantially ellipses as shown in FIG. 2. The front opening portion of the frame 10W for the woofer 1W has a front end portion 11W whose cross-section is of substantially an L-shape and a rear holding portion 12W with a step. Further, there are provided a plurality of ribs 13W which are radially extended from the rear holding portion 12W to the front end portion 11W to connect the front end portion 11W and the rear holding portion 12W integrally.

Meanwhile, the frame 10M for the middle frequency sound speaker 1M is molded of synthetic resin to have an elliptic opening portion similar to the frame of a general ellipse type speaker.

Therefore, the frame 10M is formed such that it surrounds the under sides of the magnetic circuit and the vibration system located therein without forming holes or the like on its rear face opposing the diaphragm 14W of the woofer 1W.

The frames low and 10M mentioned above are fixed to the plate 5W and the yoke 2M by an adhesive or the like, respectively.

Then, the voice coils 8W, 8M wound around the bobbins 7W, 7M each made of a cylindrical insulator are located in the magnetic gaps 6W, 6M, respectively. The upper outer peripheral portions of bobbins 7W, 7M are joined to the center apertures of dampers 9W, 9M each made of a ring-shaped cloth or the like with a wave-like corrugation, and the outer peripheral portions of the dampers 9W, 9M are jointed to the step portion of the rear holding portion 12W and the step portion formed on the frame 10M, whereby the vibration systems including the bobbins 7W, 7M and the voice coils 8W, 8M are respectively supported by the frames 10W, 10M in a cantilever fashion.

Next, the inner diameter portions of the apertures bored through the centers of the cone type diaphragms 14W, 14M each being injection molded of synthetic resin to have elliptic opening portions are bounded to the upper portions of bobbins 7W, 7M by an adhesive or the like, the outer peripheral portion of the diaphragm 14W for the woofer 1W is joined with an edge 15W made of rubber or the like to be a convex-ring shape, and the outer periphery of the edge 15W is joined to the front end portion 11W of frame low and fixed thereto via a gasket 16W.

The diaphragm 14M for the middle frequency sound speaker 1M is of a cone shape with a sound emitting opening of an ellipse which is smaller in area than that of the diaphragm 14W for the woofer 1W and is injection-molded of synthetic resin of a fix edge type integral with an edge, and the outer periphery of diaphragm 14M is held to the front end inner periphery of the frame 10M by an elliptic and ring-shaped gasket 16M.

On the center pole 3W of the woofer 1W arranged as described above, there is planted a support column 17 made of aluminum as a circular cylinder by a screw or the like. Then, the bottom surface of the frame 10M for the middle frequency sound speaker 1M is fixedly bonded to the front end of the support column 17, in such a manner that the center axis of the ellipse of the woofer 1W is coincident with the center axis of the ellipse of the middle frequency sound speaker 1M.

Further, a ring-shaped dust cap 18W having a center bore is joined to the inner peripheral portion of the diaphragm 14W, and the support column 17 passes through the center bore of the dust cap 18W. Thus, the diaphragm 14W can vibrate forward and backward freely. To the center position of the diaphragm 14M of the middle frequency sound speaker 1M bonded is a dome-shaped dust cap 18M made of synthetic resin to close the center bore of the diaphragm 14M.

According to the speaker unit of the present invention, if it is assumed that the longest diameter and the shortest diameter of the ellipse of the diaphragm 14W of the woofer 1W are taken as LD1 and SD1, respectively and also the longest diameter and the shortest diameter of the ellipse of the diaphragm 14M of the middle frequency sound speaker 1M are taken as LD2 and SD2, respectively, the shapes of the ellipses are selected to satisfy the following equation (1).

$$\frac{LD_1}{SD_1} + \frac{SD_2}{LD_2} = 1 \tag{1}$$

That is, the shapes of the diaphragms 14W and 14M of the woofer 1W and the middle and high frequency sound speaker 1M are selected and arranged such that the middle and high frequency sound speaker 1M is located on the center axis of the woofer 1W and the longest diameters and the shortest diameters thereof are made coincident respectively, so that the longer diameter direction and shorter diameter direction of the middle and high frequency sound speaker 1M seen from the longer diameter direction and the shorter diameter directions the diaphragm 14W of the woofer 1W become same in ratio. Thus, there is caused no phase difference by the difference in ratio between the longer diameter and the shorter diameter so that no difference is caused in directivity characteristics between the longer diameter direction and the shorter diameter direction. Therefore, the peak and the dip on the frequency characteristic can be reduced, whereby it becomes possible to improve the frequency characteristic.

Incidentally, in a case where the longest diameters and the shortest diameters of the woofer 1W and the middle and high frequency sound speaker 1M are made coincident, respectively, if the longest diameter LD2 and the shortest diameter SD2 of the middle and high frequency sound speaker 1M are each taken as 1, the respective ratios between them and the longest diameter LD1 and the shortest diameter SD1 of the woofer 1W are desirably selected in the range of ⅓ to ½.5, as shown by:

$$\frac{1}{3} < \frac{LD2}{LD1} < \frac{1}{2.5} \text{ and } \frac{1}{3} < \frac{SD2}{SD1} < \frac{1}{2.5}$$

For example, when the longest diameter LD1 of woofer 1W is 18 cm and the shortest diameter SD1 of the woofer 1W is 12 cm, the range of the longest diameter LD2 of the middle and high frequency sound speaker 1M is 6 to 7.2 cm and from this range the longest diameter LD2 of sound speaker 4M could be selected as 6.6 cm, the range of the shortest diameter of the middle and high range sound speaker 1M is 4 to 4.8 cm and from this range the shortest diameter SD2 of sound speaker 1M could be selected as 4.4 cm. When the ratios LD2/LD1 and SD2/SD1 are less than ⅓, the middle frequency sound of the middle and high frequency sound speaker 1M is weak and voice sounds are not reproduced suitably. When the ratios LD2/LD1 and SD2/SD1 are more than ½.5, reflections of the sounds from the woofer 1W by the middle and high frequency sound speaker 1M are increased, so that the sound becomes stuffy.

Further, according to the present invention, the diaphragm 14M used in the speaker 1M is injection-molded from synthetic resin, for example, a fixed edge type diaphragm is shaped as a cone-shaped ellipse and the thickness thereof, as shown in FIG. 1. At the edge portion thereof, the compliance is made large to reduce the dip and the peak on the frequency characteristic upon reproducing a middle frequency band sound, and at the same time the strength is made strong at the inner diameter portion to enhance the reinforcing effect.

In the elliptic type speaker unit described in connection with FIGS. 1 and 2, the two-way speaker unit is described, but the arrangement of a three-way speaker unit will be described with reference to FIG. 4.

Figure 4:
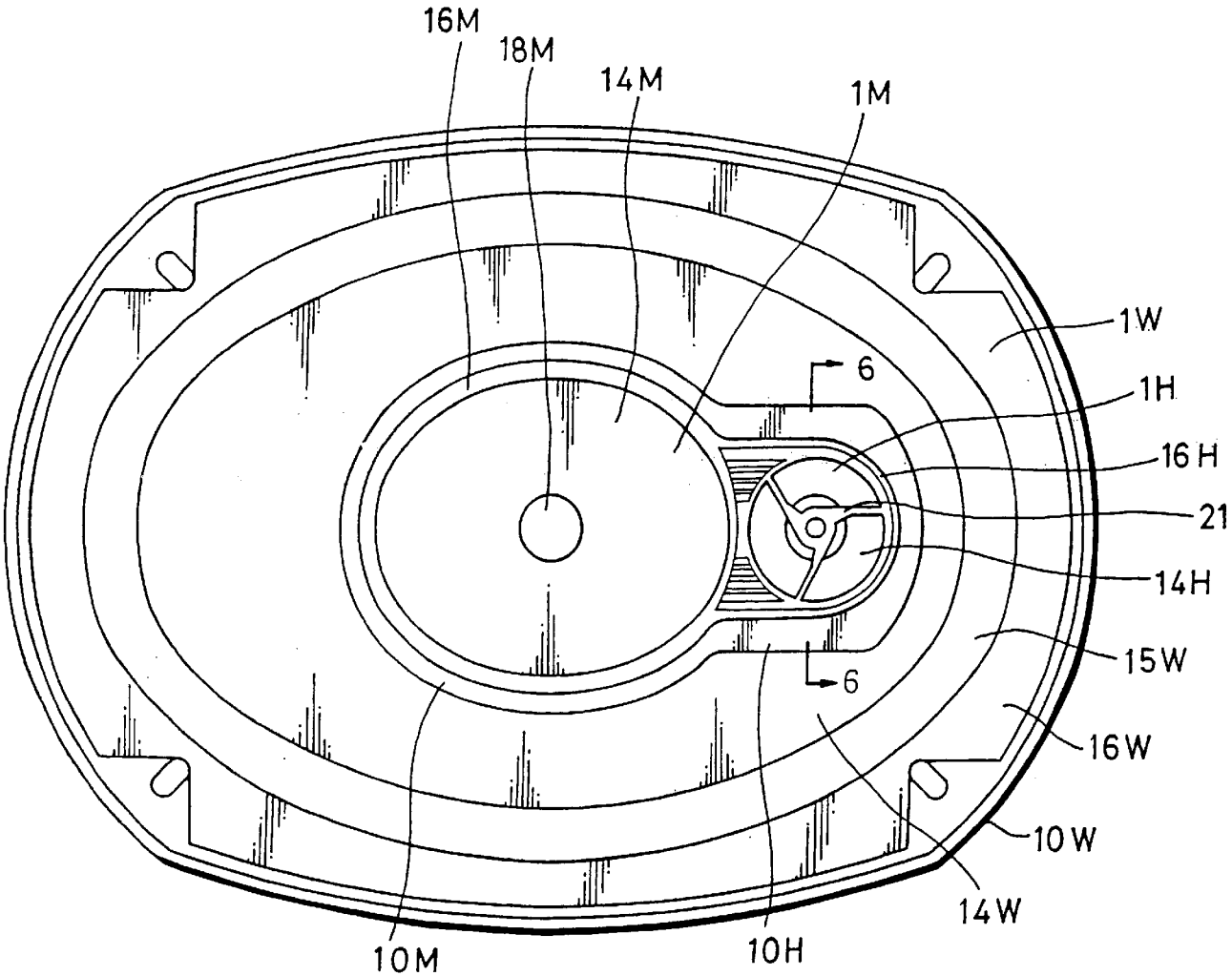
FIG. 4 is a plan view showing the speaker unit according to another embodiment of the present invention.

FIG. 4 is a plan view showing a three-way speaker unit according to the present invention, in which the parts corresponding to those of FIG. 2 are marked with the same references and the duplicate description thereof will be omitted. In this embodiment, at the center axis of the woofer 1W as the elliptic type low frequency sound speaker, there is coaxially located an elliptic tape middle frequency sound speaker 1M similar to that described in connection with FIGS. 1 and 2. At the same time, on the right side or the left side of the diaphragm 14M of the elliptic type middle frequency sound speaker 1M in the longest diameter direction, a first high frequency sound speaker (hereinafter referred to as a first tweeter) 1H is disposed. In this case, the reproduction frequency band is about 50 Hz to 3 KHz for the woofer 1W, about 3 KHz to 10 KHz for the middle frequency sound speaker 1M, and about 10 KHz to 15 KHz for the first tweeter 1H.

Figure 5:
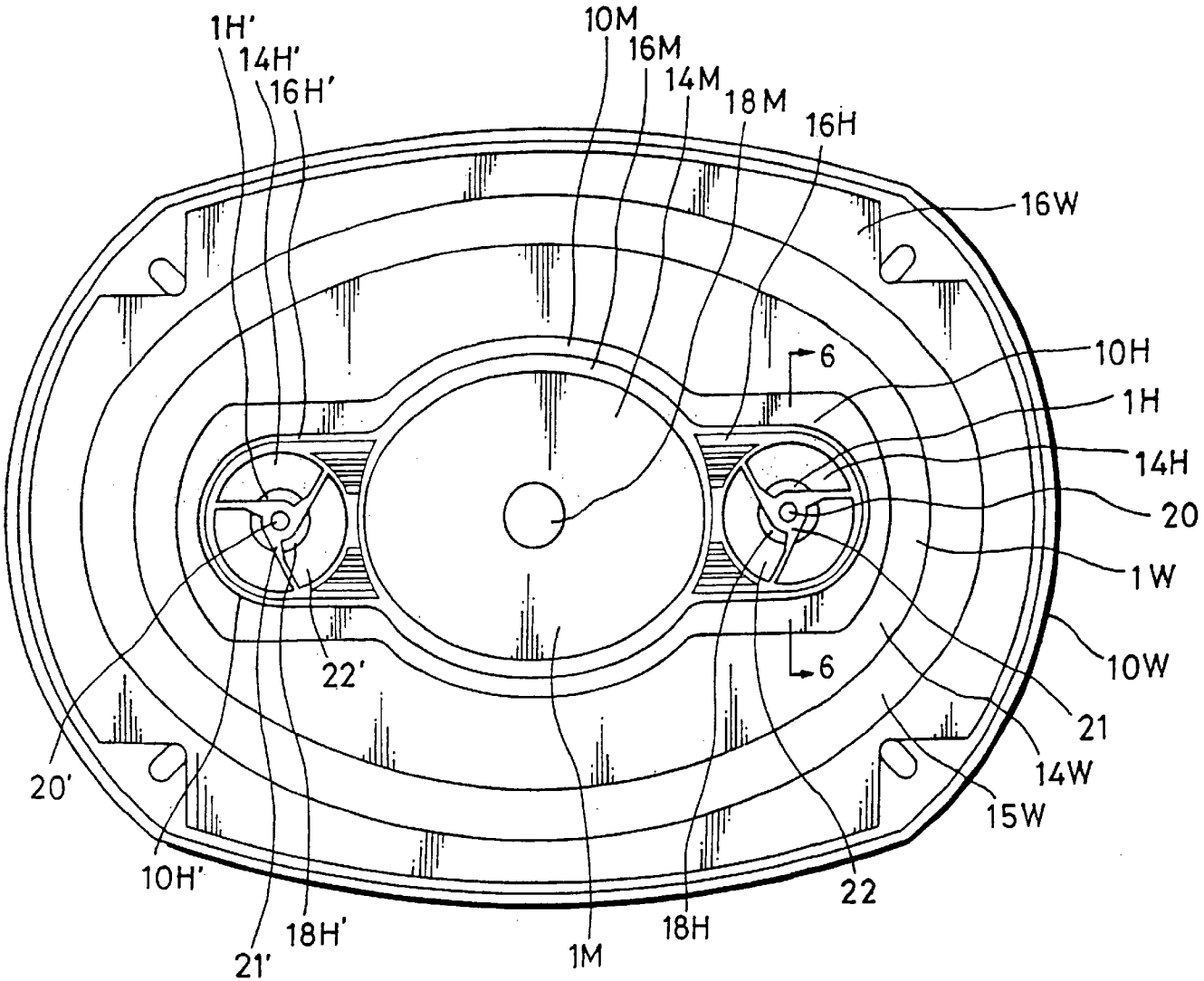
FIG. 5 is a plan view showing the speaker unit according to a further embodiment of the present invention.
Figure 6:
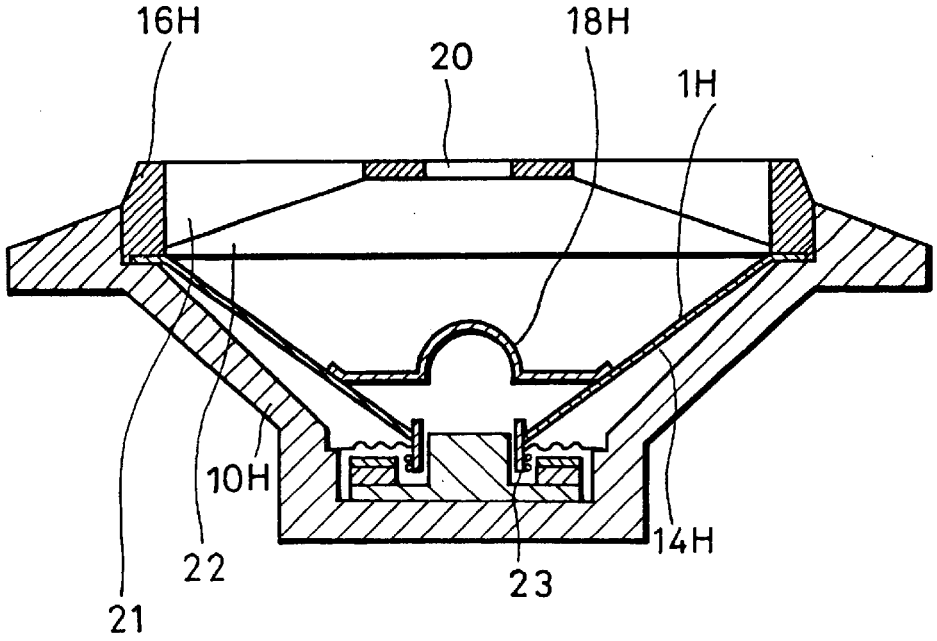
FIG. 6 is a cross-sectional view on the 6—6 lines in FIGS. 4 and 5.

FIG. 5 is a plan view showing a speaker unit according to a further embodiment of the present invention. FIG. 6 is a cross-sectional view on the line 6—6 in FIGS. 4 and 5.

In FIGS. 4 and 6, the first tweeter 1H is located at the right end in the longest diameter direction of the middle frequency sound speaker 1M fixed on the support column 17 planted on the center axis of the woofer 1W.

In this case, the frame 10M of the middle frequency sound speaker 1M formed as a funnel shape so as to surround the magnetic circuit of the middle frequency sound speaker 1M from the lower side thereof is formed integral with a tweeter holding frame 10H to hold the first tweeter 1H.

That is, the frame 10H for holding the first tweeter 1H made of a U-letter shape plate projection member is extended from the outer peripheral end of the frame 10M of the middle frequency sound speaker 1M at the right end in the longest diameter direction of the frame 10M of the middle frequency sound speaker 1M whose plane is shaped as an ellipse approximately.

A bore 22 punched out a triple type protective plate 21, which protects the front surface of the diaphragm 14M of the tweeter 1H, with a bore 20 at its center portion, is formed through the frame 10H. Then, this frame 10H is made integral with a gasket 16M of the middle frequency sound speaker 1M to be a semi-circular gasket 16H molded and the whole shape of the gasket 16H is set an U-letter shape projected portion at the right end in the longest diameter direction of the elliptic gasket 16M of the middle frequency sound speaker 1M.

The tweeter frame 10H extended from the frame 10M of the middle frequency sound speaker 1M is molded integral therewith and the whole shape of its plane is approximately an ellipse including the gasket 16M of the middle frequency sound speaker 1M and the U-shaped gasket 16H of the tweeter 1H.

Further, as described in detail with reference to FIG. 6, in the first tweeter 1H, a magnetic circuit 23 is mounted on or fixed to the bottom of the frame 10H molded from the synthetic resin and integrated with the frame 10M of the middle frequency sound speaker 1M, and also the largest diameter outer periphery of the diaphragm 14H injection-molded from the synthetic resin is fixed to the step portion formed on the frame 10H through the gasket 16H integrated with the protective plate 21.

In FIG. 6, although as the tweeter 1H, the magnetic circuit 23, the diaphragm 14H and the dust cap 18H are only shown, the magnetic circuit 23 includes therein the magnet and the voice coil of the structure same as that of the middle frequency sound speaker 1M shown in FIG. 1 to be, for example, the electrodynamic type speaker arrangement and the diaphragm is formed to be of a cone shape. Of course, the edge is formed as a fixed edge. Since the arrangement thereof is the same as the middle frequency sound speaker 1M of FIG. 1, the detailed description thereof will be omitted.

Figure 3:
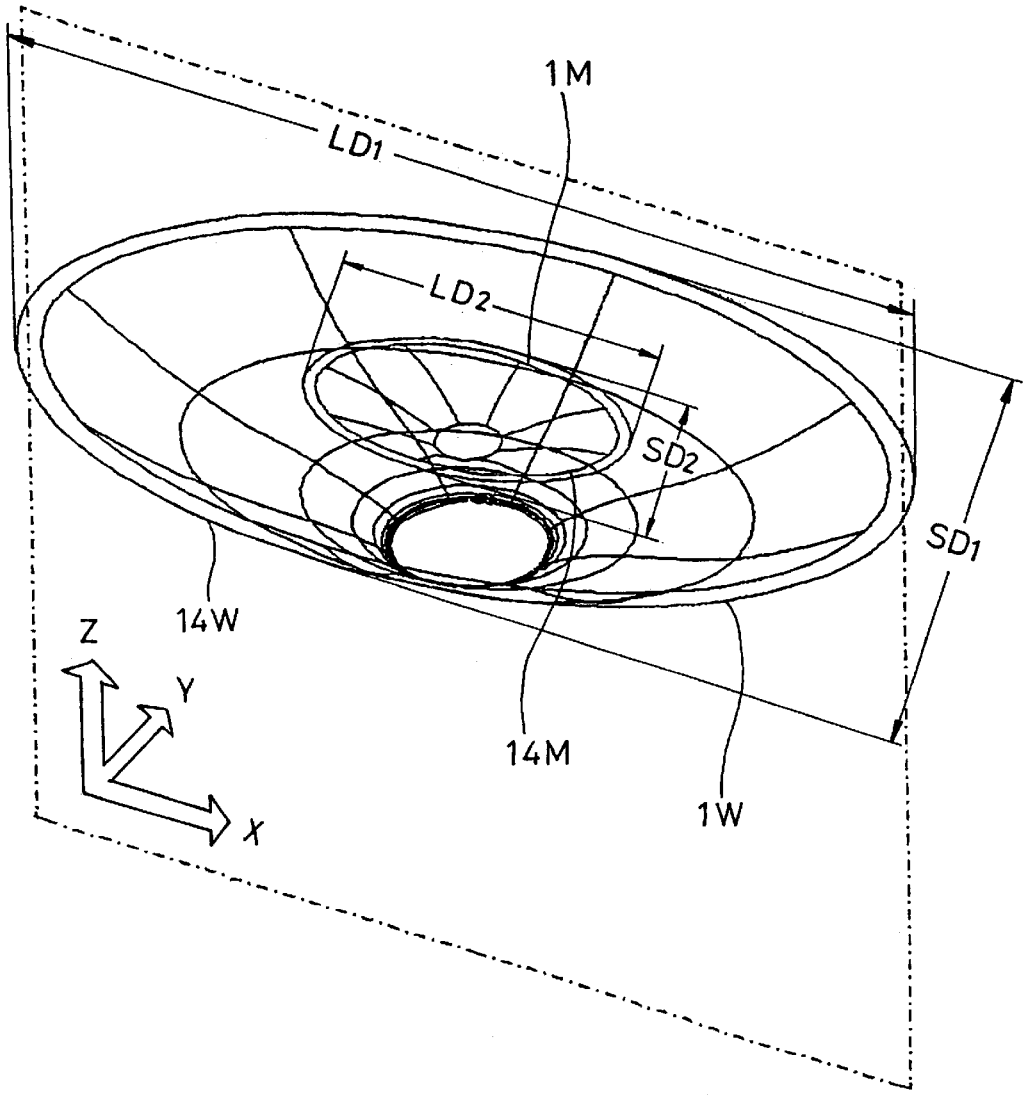
FIG. 3 is a perspective view used to explain the shape of a diaphragm of the speaker unit according to the present invention.

By the way, although the speaker 1M is made for the middle frequency sound in FIG. 3, it is needless to say that the speaker 1M of the embodiment may be a speaker for the middle and high frequency sound or the frequency band, for example, 3 KHz to 15 KHz.

In a speaker unit of the present invention shown in FIG. 5, a second high frequency sound speaker (hereinafter, referred to as a second tweeter) 1H' is added to the embodiment shown in FIG. 4. Therefore, in FIG. 5 the parts same as those in FIG. 4 are marked with the same references and the detailed description thereof will be omitted.

The second tweeter 1H' is provided at a position opposing the first tweeter 1H with the middle frequency sound speaker 1M sandwiched therebetween, namely at the left end in the longest diameter direction of the elliptic sound emitting opening of the middle frequency sound speaker 1M. The arrangement and attaching structure of the second tweeter 1H' are similar to those of the first tweeter 1H. The reproduction frequency band of the speaker unit shown in FIG. 5 is selected such that about 50 Hz to 3 KHz are shared for the woofer 1W, about 3 KHZ to 10 KHz for the middle frequency sound speaker 1M, about 10 KHZ to 15 KHz for the first tweeter 1H, and about 15 KHz to 20 KHz for the second tweeter 1H', respectively.

While in FIG. 4 the first tweeter 1H is located on the right side of the middle frequency sound speaker 1M, it may be possible that the shape of the sound emitting opening of the first tweeter 1H shown in FIG. 4 is formed as an elliptic shape and the first tweeter 1H is located at the front of the middle frequency sound speaker 1M with their center axes being coincided. Of course, in this case the longest diameter and the shortest diameter of the diaphrague 14H of the elliptic type tweeter 1H are coincident with the longest diameter and the shortest diameter of the diaphragm 14M of the middle frequency sound speaker 1M of elliptic shape, respectively.

According to the speaker unit of the present invention, since the elliptic type woofer and at least the elliptic type middle frequency sound speaker are disposed coaxially, when the speaker unit is seen from the front side, the distance from the outer periphery of the diaphragm of the woofer to the outer peripheral edge of the frame, to which the diaphragm of the middle frequency sound speaker is attached and directed to the center axis can be made substantially equal at any places. Therefore, it is possible to present a speaker unit which reduces the phase difference, improves the directivity characteristic, reduces the peak and the dip on the frequency characteristic and is installed in a narrow space.

Having described preferred embodiments of the present invention with reference to the accompanying drawings, it is to be understood that the present invention is not limited to the above mentioned embodiments and that various changes and modifications can be effected therein by one skilled in the art without departing from the spirit or scope of the present invention as defined in the appended claims.

What is claimed is:

1. A speaker unit comprising:

a woofer having a diaphragm with an elliptically shaped sound emitting opening; and a separate speaker having an elliptically shaped diaphragm with an area smaller than an area of the diaphragm of the woofer, the separate speaker being located in front of the diaphragm of the woofer and attached at a center axis of the elliptically shaped sound emitting opening of the woofer with an open space therearound and coincident with a center axis of the elliptically shaped diaphragm of the separate speaker, and the separate speaker emitting a sound higher in frequency than a sound of the woofer, wherein the separate speaker having the elliptically shaped diaphragm is attached in such a manner that a longest diameter and a shortest diameter of the ellipse thereof are made respectively coincident with a longest diameter and a shortest diameter of the elliptically shaped sound emitting opening of the woofer, and wherein when the longest diameter and the shortest diameter of the elliptically shaped sound emitting opening of the separate speaker are each taken as 1, respective ratios thereof relative to a longest diameter and a shortest diameter of the elliptically shaped diaphragm of the woofer are selected to be between ⅓ and ½.5, respectively.

2. The speaker unit as claimed in claim 1, wherein a reproduction frequency band of the separate speaker is set for a midrange frequency sound.

3. A speaker unit as claimed in claim 2, wherein a high frequency sound speaker is attached to the separate speaker in a longest diameter direction of the separate speaker.

4. A speaker unit comprising:

a woofer having a diaphragm with an elliptically shaped sound emitting opening; and a separate speaker having an elliptically shaped diaphragm with an area smaller than an area of the diaphragm of the woofer, the separate speaker being located in front of the diaphragm of the woofer and attached at a center axis of the elliptically shaped sound emitting opening of the woofer with an open space therearound and coincident with a center axis of the elliptically shaped diaphragm of the separate speaker, and the separate speaker emitting a sound higher in frequency than a sound of the woofer, wherein the separate speaker having the elliptically shaped diaphragm is attached in such a manner that a longest diameter and a shortest diameter of the ellipse thereof are made coincident with a longest diameter and a shortest diameter of the elliptically shaped sound emitting opening of the woofer, and wherein a cone of the elliptically shaped diaphragm of the separate speaker is made of synthetic resin having a thickness thereof set to become gradually thinner from its center portion to its outer periphery portion.

* * * * *